US010923275B2

(12) United States Patent
Kainaga et al.

(10) Patent No.: US 10,923,275 B2
(45) Date of Patent: Feb. 16, 2021

(54) STATIONARY INDUCTION APPARATUS

(71) Applicant: Mitsubishi Electric Corporation, Chiyoda-ku (JP)

(72) Inventors: Soichiro Kainaga, Chiyoda-ku (JP); Takao Tsurimoto, Chiyoda-ku (JP)

(73) Assignee: MITSUBISHI ELECTRIC CORPORATION, Tokyo (JP)

( * ) Notice: Subject to any disclaimer, the term of this patent is extended or adjusted under 35 U.S.C. 154(b) by 290 days.

(21) Appl. No.: 16/077,676

(22) PCT Filed: Nov. 16, 2016

(86) PCT No.: PCT/JP2016/083952
§ 371 (c)(1),
(2) Date: Aug. 13, 2018

(87) PCT Pub. No.: WO2017/149849
PCT Pub. Date: Sep. 8, 2017

(65) Prior Publication Data

US 2019/0035552 A1 Jan. 31, 2019

(30) Foreign Application Priority Data

Mar. 4, 2016 (JP) ..... JP2016-042422

(51) Int. Cl.
*H01F 27/08* (2006.01)
*H01F 41/063* (2016.01)
(Continued)

(52) U.S. Cl.
CPC ..... *H01F 41/063* (2016.01); *H01F 27/24* (2013.01); *H01F 27/323* (2013.01);
(Continued)

(58) Field of Classification Search
CPC ..... H01F 41/063; H01F 30/10; H01F 27/324; H01F 27/24; H01F 27/323; H01F 41/122;
(Continued)

(56) References Cited

U.S. PATENT DOCUMENTS 3,086,184 A * 4/1963 Nichols ..... H01F 27/322 336/60
3,789,337 A * 1/1974 Sheppard ..... H01F 27/303 336/60
9,734,943 B2 * 8/2017 Liu ..... H01F 27/2876

FOREIGN PATENT DOCUMENTS

JP 61-47614 A 3/1986
JP 2013-254771 A 12/2013

* cited by examiner

*Primary Examiner* — Tuyen T Nguyen
(74) *Attorney, Agent, or Firm* — Xsensus LLP

(57) ABSTRACT

A stationary induction apparatus includes a core, a first winding, a second winding, and an insulating structure arranged between facing surfaces of the first winding and the second winding. The insulating structure is located between the facing surfaces of the first winding and the second winding. The insulating structure includes a first insulator having a cylindrical shape with the core as its central axis, and first insulating spacers arranged between the first winding and the first insulator and between the second winding and the first insulator. The first insulator includes a first nonlinear resistive layer containing a nonlinear resistive material having a nonlinear volume resistivity that decreases when an electric field is higher than a threshold. The first nonlinear resistive layer is provided in a portion of the first insulator which is at least in contact with one of the first insulating spacers.

10 Claims, 7 Drawing Sheets

(51) Int. Cl.

| | |
|---|---|
| ***H01F 30/10*** | (2006.01) |
| ***H01F 27/32*** | (2006.01) |
| ***H01F 27/24*** | (2006.01) |
| ***H01F 41/12*** | (2006.01) |
| *H01F 27/36* | (2006.01) |
| *H01F 27/02* | (2006.01) |
| *H01F 27/10* | (2006.01) |
| *H01F 27/28* | (2006.01) |

(52) U.S. Cl.
CPC ..... *H01F 27/324* (2013.01); *H01F 30/10* (2013.01); *H01F 41/122* (2013.01); *H01F 27/02* (2013.01); *H01F 27/08* (2013.01); *H01F 27/10* (2013.01); *H01F 27/2823* (2013.01); *H01F 27/36* (2013.01)

(58) Field of Classification Search
CPC ..... H01F 27/10; H01F 27/08; H01F 27/02; H01F 27/2823; H01F 27/36
See application file for complete search history.

STATIONARY INDUCTION APPARATUS

TECHNICAL FIELD

The present invention relates to stationary induction apparatuses.

BACKGROUND ART

Japanese Patent Laying-Open No. 61-47614 (PTD 1) and Japanese Patent Laying-Open No. 2013-254771 (PTD 2) are prior art documents each disclosing the configuration of a stationary induction apparatus. The stationary induction apparatus described in PTD 1 includes a core, windings wound around the core, and wedges inserted into the windings to form a cooling duct of air gap. Some or all of the wedges are made of a nonlinear resistive material. Electric field concentration is relieved by a discharge voltage of the nonlinear low-resistance material for uniform potential distribution between turns sandwiching the cooling duct.

The stationary induction apparatus described in PTD 2 includes a first winding wound into a disc, a second winding wound into a disc different from that of the first winding, and a duct piece. The surface of the duct piece is made of a nonlinear resistive material. The nonlinear resistive material relieves electric field concentration caused by a wedge gap, so that dielectric breakdown is less likely to occur in the wedge gap.

CITATION LIST

Patent Document

PTD 1: Japanese Patent Laying-Open No. 61-47614
PTD 2: Japanese Patent Laying-Open No. 2013-254771

SUMMARY OF INVENTION

Technical Problem

When at least the surface of the duct piece is made of a nonlinear resistive material as in the stationary induction apparatus described in PTD 1 or PTD 2, providing the nonlinear resistive material takes time, leading to a longer time required for manufacturing the duct piece. Since a large number of duct pieces are used to manufacture a stationary induction apparatus, a longer time required for manufacturing the duct piece leads to a longer time required for manufacturing the stationary induction apparatus, thereby increasing the cost of manufacturing the stationary induction apparatus.

The present invention has been made in view of the above problem, and has an object to provide a stationary induction apparatus that can stably relieve electric field concentration and is inexpensive.

Solution to Problem

A stationary induction apparatus according to the present invention includes a core, a first winding, a second winding, and an insulating structure. The first winding and the second winding are each wound in a cylindrical shape with the core as its central axis. The first winding and the second winding have facing surfaces that face each other. The insulating structure is arranged between the facing surfaces of the first winding and the second winding. The insulating structure includes a first insulator and a plurality of first insulating spacers. The insulating structure is located between the facing surfaces of the first winding and the second winding at an interval from each of the first winding and the second winding and has a cylindrical shape with the core as its central axis. The plurality of first insulating spacers are each arranged between the first winding and the first insulator and between the second winding and the first insulator and extend along an extension direction parallel to the central axis. The first insulator includes a first nonlinear resistive layer containing a nonlinear resistive material having a nonlinear volume resistivity that decreases when an electric field that acts on the nonlinear resistive material is higher than a threshold. The first nonlinear resistive layer is provided in a portion of the first insulator which is at least in contact with a corresponding one of the plurality of first insulating spacers.

Advantageous Effects of Invention

The present invention can inexpensively manufacture a stationary induction apparatus capable of stably relieving electric field concentration.

DESCRIPTION OF EMBODIMENTS

Figure 1:
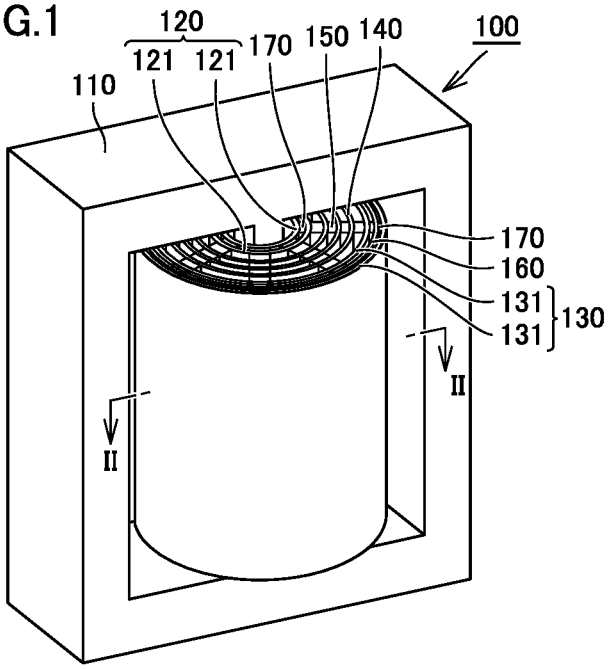
FIG. 1 is a perspective view showing an appearance of a stationary induction apparatus according to Embodiment 1 of the present invention.

Stationary induction apparatuses according to embodiments of the present invention will be described hereinafter with reference to the drawings. In the following embodiments, the same or corresponding components will be denoted by the same reference numerals, and a description thereof will not be repeated.

Embodiment 1

Figure 2:
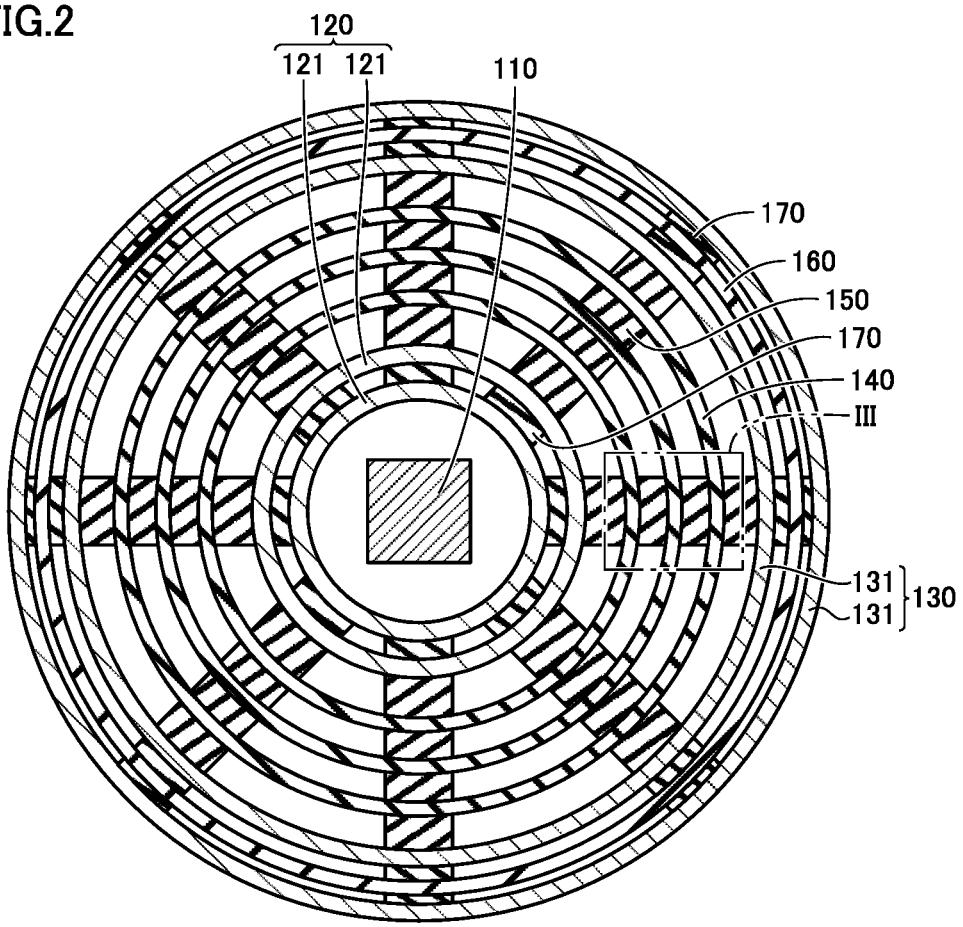
FIG. 2 is a sectional view of the stationary induction apparatus according to Embodiment 1 of the present invention, which is seen from the arrow II-II of FIG. 1.
Figure 3:
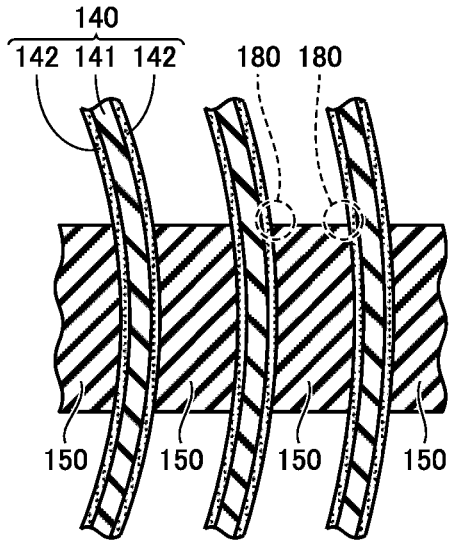
FIG. 3 is a sectional view of the stationary induction apparatus according to Embodiment 1 of the present invention, which shows an enlarged portion III of FIG. 2.

FIG. 1 is a perspective view showing an appearance of a stationary induction apparatus according to Embodiment 1 of the present invention. FIG. 2 is a sectional view of the stationary induction apparatus according to Embodiment 1 of the present invention, which is seen from the arrow II-II of FIG. 1. FIG. 3 is a sectional view of the stationary induction apparatus according to Embodiment 1 of the present invention, which shows an enlarged portion III of FIG. 2.

As shown in FIGS. 1 to 3, a stationary induction apparatus 100 according to Embodiment 1 of the present invention is a core-type transformer. Stationary induction apparatus 100 includes a core 110, and a first winding 120 and a second winding 130 concentrically wound around a main leg of core 110, where the main leg is the central axis. Second winding 130 is located outside first winding 120. First winding 120 and second winding 130 have facing surfaces that face each other. Specifically, the outer circumferential surface of first winding 120 and the inner circumferential surface of second winding 130 are the facing surfaces that face each other.

Stationary induction apparatus 100 includes a tank (not shown). The tank is filled with an insulating oil that is an insulating medium as well as a cooling medium. Used as the insulating oil is, for example, a mineral oil, an ester oil, or a silicon oil. Core 110, first winding 120, and second winding 130 are housed in the tank.

First winding 120 is formed of a plurality of winding layers 121 concentrically arranged and electrically connected to each other. Each of winding layers 121 is formed of a flat-type electric wire wound in a cylindrical shape. Second winding 130 is formed of a plurality of winding layers 131 concentrically arranged and electrically connected to each other. Each of winding layers 131 is formed of a flat-type electric wire wound in a cylindrical shape.

Stationary induction apparatus 100 further includes a second insulator 160 located at an interval from each of adjacent winding layers 131 of winding layers 131 so as to isolate the adjacent winding layers 131 from each other in second winding 130. Second insulator 160 has a cylindrical outside shape with the main leg of core 110 as its central axis. Second insulator 160 is arranged concentrically with winding layers 131. Used as second insulator 160 is, for example, a press board.

In the present embodiment, no second insulator 160 is arranged between adjacent winding layers 121 of first winding 120. One second insulator 160 is arranged between adjacent winding layers 131 of second winding 130.

The number of second insulators 160 arranged between adjacent winding layers 121 is changed appropriately depending on the magnitude of a potential difference generated between adjacent winding layers 121. The number of second insulators 160 arranged between adjacent winding layers 131 is changed appropriately depending on the magnitude of a potential difference generated between adjacent winding layers 131. Second insulator 160 thus does not need to be always provided.

At a much larger potential difference generated between adjacent winding layers 121 of first winding 120, at least one second insulator 160 is arranged between adjacent winding layers 121 of first winding 120.

At a much larger potential difference generated between adjacent winding layers 131 of second winding 130, second insulators 160 are arranged between adjacent winding layers 131 of second winding 130.

Stationary induction apparatus 100 further includes a plurality of second insulating spacers 170 that are arranged between adjacent winding layers 121 of first winding 120 and between adjacent winding layers 131 of second winding 130 and extend along the extension direction parallel to the central axis. Used as second insulating spacer 170 is, for example, a press board or a resin stack.

Some of second insulating spacers 170 are sandwiched between adjacent winding layers 121 of first winding 120. The other second insulating spacers 170 are each sandwiched between winding layer 131 and second insulator 160 adjacent to each other. When second insulators 160 are arranged between adjacent winding layers 121 of first winding 120 and second insulators 160 are arranged between adjacent winding layers 131 of second winding 130, additional second insulating spacers 170 are sandwiched between adjacent second insulators 160.

Second insulating spacers 170 are each arranged at regular intervals circumferentially between adjacent winding layers 121 of first winding 120, between winding layer 131 and second insulator 160 adjacent to each other, and between adjacent second insulators 160. A portion between adjacent winding layers 121 of first winding 120, a portion between winding layer 131 and second insulator 160 adjacent to each other, and a portion between adjacent second insulators 160, in which no second insulating spacer 170 is located, serve as a flow path for the insulating oil.

The intervals at which second insulating spacers 170 are arranged circumferentially are not limited to regular intervals. It suffices that these intervals may be determined so as to maintain the interval between adjacent winding layers 121 of first winding 120, the interval between winding layer 131 and second insulator 160 adjacent to each other, and the interval between adjacent second insulators 160.

Stationary induction apparatus 100 further includes an insulating structure arranged between the facing surfaces of first winding 120 and second winding 130. The insulating structure includes a first insulator 140 and a plurality of first insulating spacers 150. First insulator 140 is located between the facing surfaces of first winding 120 and second winding 130 at an interval from each of first winding 120 and second winding 130 so as to isolate the facing surfaces of first winding 120 and second winding 130 from each other. Specifically, first insulator 140 is located at an interval from each of first winding 120 and second winding 130 so as to isolate the outer circumferential surface of first winding 120 and the inner circumferential surface of second winding 130 from each other.

First insulator 140 has a cylindrical outside shape with the main leg of core 110 as its central axis. First insulator 140 is arranged concentrically with first winding 120 and second winding 130.

In the present embodiment, three first insulators 140 are arranged between first winding 120 and second winding 130. The number of first insulators 140 arranged between first winding 120 and second winding 130 is changed appropriately depending on the magnitude of a potential difference generated between first winding 120 and second winding 130.

First insulating spacers 150 are each arranged between first winding 120 and first insulator 140 and between second winding 130 and first insulator 140 and extend along the extension direction parallel to the central axis. In the present embodiment, since stationary induction apparatus 100 includes first insulators 140, first insulating spacer 150 is also arranged between adjacent first insulators 140. Used as first insulating spacer 150 is, for example, a press board or a resin stack.

One of first insulating spacers 150 is sandwiched between winding layer 121 and first insulator 140 adjacent to each other. Some of first insulating spacers 150 are each sandwiched between adjacent first insulators 140. The other second insulating spacer 170 is sandwiched between winding layer 131 and first insulator 140 adjacent to each other.

First insulating spacers 150 are each arranged at regular intervals circumferentially between winding layer 121 and first insulator 140 adjacent to each other, between adjacent first insulators 140, and between winding layer 131 and first insulator 140 adjacent to each other. A portion between winding layer 121 and first insulator 140 adjacent to each other, a portion between adjacent first insulators 140, and a portion between winding layer 131 and first insulator 140 adjacent to each other, in which no first insulating spacer 150 is located, serve as a flow path for the insulating oil.

The intervals at which first insulating spacers 150 are arranged circumferentially are not limited to regular intervals. It suffices that these intervals are determined so as to maintain the interval between winding layer 121 and first insulator 140 adjacent to each other, the interval between adjacent first insulators 140, and the interval between winding layer 131 and first insulator 140 adjacent to each other.

As shown in FIG. 3, first insulator 140 includes first nonlinear resistive layers 142 containing a nonlinear resistive material having a nonlinear volume resistivity that decreases when an electrical field that acts on the nonlinear resistive material is higher than a threshold. In the present embodiment, first insulator 140 includes a first insulating layer 141 made of insulating material and first nonlinear resistive layers 142 covering the opposite surfaces of first insulating layer 141. First nonlinear resistive layers 142 are provided in portions of first insulator 140 which are at least in contact with first insulating spacer 150. Used as the material for first insulating layer 141 is, for example, a press board.

As to the characteristics of the nonlinear resistive material, its volume resistivity changes with respect to an electric field in a nonlinear manner. Specifically, at an electric field acting on the nonlinear resistive material which is not higher than the threshold, the volume resistivity of the nonlinear resistive material is kept high. At an electric field acting on the nonlinear resistive material which is higher than the threshold, the volume resistivity of the nonlinear resistive material decreases.

Although first nonlinear resistive layer 142 contains SiC that is a nonlinear resistive material in the present embodiment, the nonlinear resistive material is not limited to this and is, for example, ZnO, MgO, ZnSe, CdTe, AlGa, InP, GaAs, InSb, GaP, GaN, AlP, InN, InAs, NaCl, AgBr, CuCl, or diamond.

One type of the above nonlinear resistive materials may be used alone, or several types of these materials may be mixed for use. In the use of several types of nonlinear resistive materials mixed together, each of the volume resistivity of the nonlinear resistive layer at an electric field not higher than the threshold, the volume resistivity of the nonlinear resistive layer at an electric field higher than the threshold, and the threshold of the electric field at which the volume resistivity of the nonlinear resistive layer decreases can be adjusted.

One example of the method of forming first nonlinear resistive layer 142 is a method of forming a layer by mixing a nonlinear resistive material into a binder resin or cellulose for forming a layer and applying the mixture to an object, followed by curing in a room temperature atmosphere or high temperature atmosphere. Non-limiting examples of the method of applying the mixture include brush coating, roller coating, spray coating with a spray gun, baking coating, dip coating, and electrostatic coating of charging powder of nonlinear resistive material with static electricity and bonding the powder to an object.

A thermoplastic resin or a thermosetting resin can be used as the binder resin. In the use of the thermoplastic resin as the binder resin, for example, a polyvinyl chloride resin, a polyester resin, a nylon resin, a polyvinyl acetate resin, or a starch resin can be used. In the use of the thermosetting resin as the binder resin, for example, an epoxy resin, a urethane resin, a phenol resin, or an acrylic resin can be used.

For first nonlinear resistive layer 142 to have nonlinear resistive properties and have required mechanical properties, the content of the nonlinear resistive material needs to fall within a range of a preset value. For example, in the use of SiC as the nonlinear resistive material, the content of the nonlinear resistive material needs to fall within a range of 30 vol % or more and 80 vol % or less. At a SiC content of less than 30 vol %, the contact between SiC materials is difficult to maintain. At a SiC content of 80 vol % or more, first nonlinear resistive layer 142 becomes excessively solid and brittle.

Figure 4:
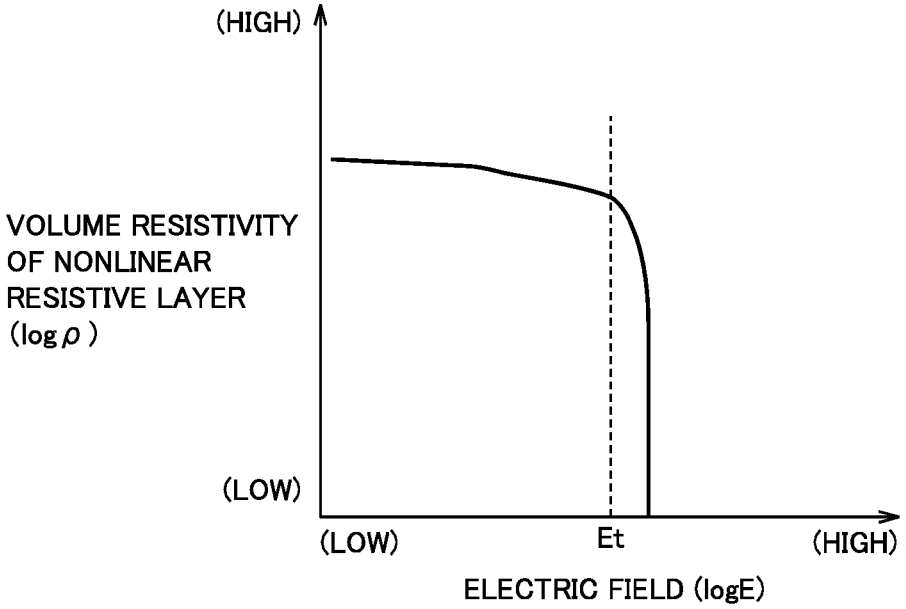
FIG. 4 is a graph showing a relationship between an electric field and a volume resistivity of a first nonlinear resistive layer of a first insulator of the stationary induction apparatus according to Embodiment 1 of the present invention.

FIG. 4 is a graph showing a relationship between an electric field and a volume resistivity of the first nonlinear resistive layer of the first insulator of the stationary induction apparatus according to Embodiment 1 of the present invention. In FIG. 4, the vertical axis represents a volume resistivity, and the horizontal axis represents an electric field.

As shown in FIG. 4, the volume resistivity of first nonlinear resistive layer 142 is approximately constant within a range of not more than a test electric field Et which acts on first nonlinear resistive layer 142 in a withstand voltage test. Thus, while an electric field is acting on first nonlinear resistive layer 142 at a voltage at the intrusion of a lighting impulse, at the occurrence of a switching impulse, or in normal operation, which is lower than the voltage in the withstand voltage test, the volume resistivity of first nonlinear resistive layer 142 is approximately constant at a high value. When the electric field that acts on first nonlinear resistive layer 142 is higher than test electric field Et, the volume resistivity of first nonlinear resistive layer 142 decreases dramatically. As described above, test electric field Et is a threshold electric field at which the volume resistivity of the nonlinear resistive material contained in first nonlinear resistive layer 142 decreases.

It suffices that while an electric field lower than test electric field Et is acting on first nonlinear resistive layer 142, the volume resistivity of first nonlinear resistive layer 142 is equal to, for example, the volume resistivity of first insulating layer 141. Analysis confirmed that while an electric field higher than test electric field Et is acting on first nonlinear resistive layer 142, the electric field concentration in an oil gap 180 surrounded by first insulator 140 and first insulating spacer 150, which will be described below, can be prevented or reduced if the volume resistivity of first nonlinear resistive layer 142 has, for example, a value smaller than the volume resistivity of first insulating layer 141 by $10^5$.

In stationary induction apparatus 100 according to the present embodiment, an electric field acts on oil gap 180 surrounded by first insulator 140 and first insulating spacer 150 in a concentrated manner, as shown in FIG. 3. When the electric field acting on first nonlinear resistive layer 142 contacting oil gap 180 is higher than test electric field Et, the volume resistivity of first nonlinear resistive layer 142 decreases, thus preventing or reducing the occurrence of partial discharge in oil gap 180.

Figure 5:
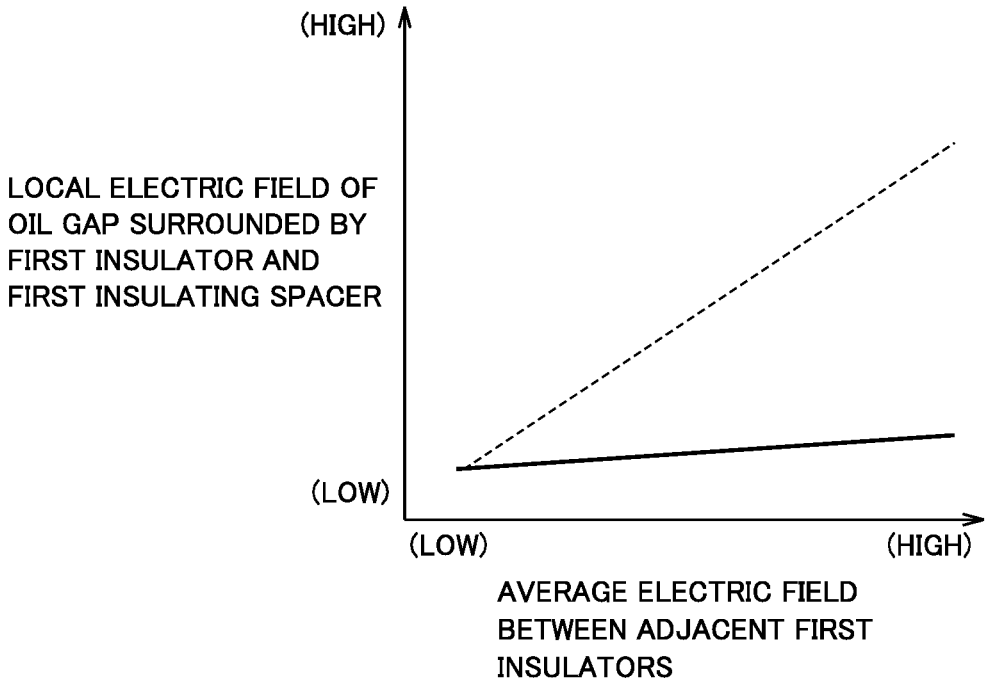
FIG. 5 is a graph showing a relationship between an average electric field between adjacent first insulators and a local electric field of an oil gap surrounded by a first insulator and a first insulating spacer in the cases where the first insulator according to Embodiment 1 of the present invention which includes the first nonlinear resistive layer is provided and where a first insulator according to a comparative example which includes no first nonlinear resistive layer is provided.

FIG. 5 is a graph showing a relationship between an average electric field between adjacent first insulators and a local electric field of an oil gap surrounded by a first insulator and a first insulating spacer in the cases where the first insulator according to Embodiment 1 of the present invention which includes the first nonlinear resistive layer is provided and where the first insulator according to a comparative example which includes no first nonlinear resistive layer is provided. In FIG. 5, the vertical axis represents a local electric field of the oil gap surrounded by the first insulator and the first insulating spacer, and the horizontal axis represents an average electric field between adjacent first insulators. Also, a solid line represents the data in the case where the first insulator according to the present embodiment is provided, and a dotted line represents the data in the case where the first insulator according to the comparative example is provided.

As shown in FIG. 5, in the case where the first insulator according to the comparative example which includes no first nonlinear resistive layer is provided, a local electric field of an oil gap surrounded by the first insulator and the first insulating spacer becomes higher as the average electric field between adjacent first insulators becomes higher. Contrastingly, in the case where first insulator 140 according to the present embodiment is provided, a local electric field of oil gap 180 surrounded by first insulator 140 and first insulating spacer 150 is approximately constant even when an average electric field between adjacent first insulators 140 becomes higher. In the case where first insulator 140 according to the present embodiment is provided, the local electric field of oil gap 180 is consequently relaxed, so that partial discharge is less likely to occur in oil gap 180.

As described above, in stationary induction apparatus 100 according to the present embodiment, first nonlinear resistive layers 142 provided on the surfaces of first insulator 140 can stably relax electric field concentration on oil gap 180, thus enhancing the insulation performance between first winding 120 and second winding 130. First nonlinear resistive layers 142 are provided not to first insulating spacers 150 but to first insulators 140 that are arranged fewer than first insulating spacers 150, thus suppressing an increase in the time required for manufacturing stationary induction apparatus 100. Consequently, stationary induction apparatus 100 can be manufactured inexpensively.

Although first nonlinear resistive layers 142 are provided over the entire opposite surfaces of first insulator 140 in the present embodiment, it suffices that first nonlinear resistive layer 142 is provided in a portion of first insulator 140 which is at least in contact with first insulating spacer 150.

Figure 6:
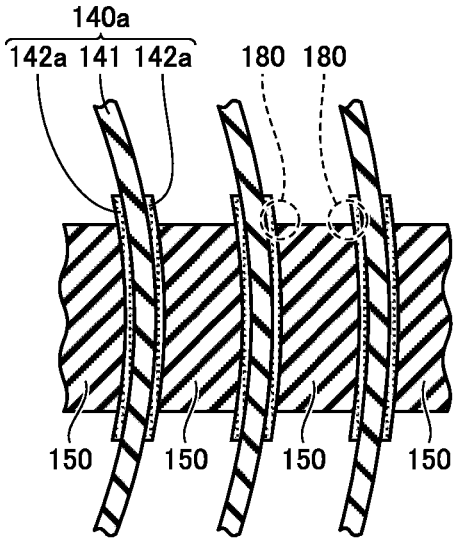
FIG. 6 is a sectional view showing a configuration of a first insulator of a stationary induction apparatus according to a modification of Embodiment 1 of the present invention.

FIG. 6 is a sectional view showing a configuration of a first insulator of a stationary induction apparatus according to a modification of Embodiment 1 of the present invention. FIG. 6 is shown in sectional view similarly to FIG. 3. As shown in FIG. 6, in a first insulator 140*a* of the stationary induction apparatus according to the modification of Embodiment 1 of the present invention, each of first nonlinear resistive layers 142*a* is partially provided in a range including a portion of first insulator 140*a* which is in contact with first insulating spacer 150 and is wider than this portion. In other words, first nonlinear resistive layer 142*a* is partially provided with an area larger than an area of first insulating spacer 150 which is in contact with first insulator 140*a*.

Consequently, the volume of first nonlinear resistive layer 142*a* on which a high electric field acts is greater than in the case where first nonlinear resistive layer 142*a* is provided only in the portion of first insulator 140*a* which is in contact with first insulating spacer 150, thus stably relaxing electric field concentration acting on oil gap 180.

Also in first insulator 140*a* of the stationary induction apparatus according to the modification of Embodiment 1 of the present invention, electric field concentration acting on oil gap 180 can be relaxed stably, thus enhancing the insulation performance between first winding 120 and second winding 130.

Embodiment 2

A stationary induction apparatus according to Embodiment 2 of the present invention will be described below. Since a stationary induction apparatus 200 according to Embodiment 2 of the present invention differs from stationary induction apparatus 100 according to Embodiment 1 only in that second nonlinear resistive layers are provided in the second insulator, the components similar to those of stationary induction apparatus 100 according to Embodiment 1 will be denoted by the same reference signs, and description thereof will not be repeated.

Figure 7:
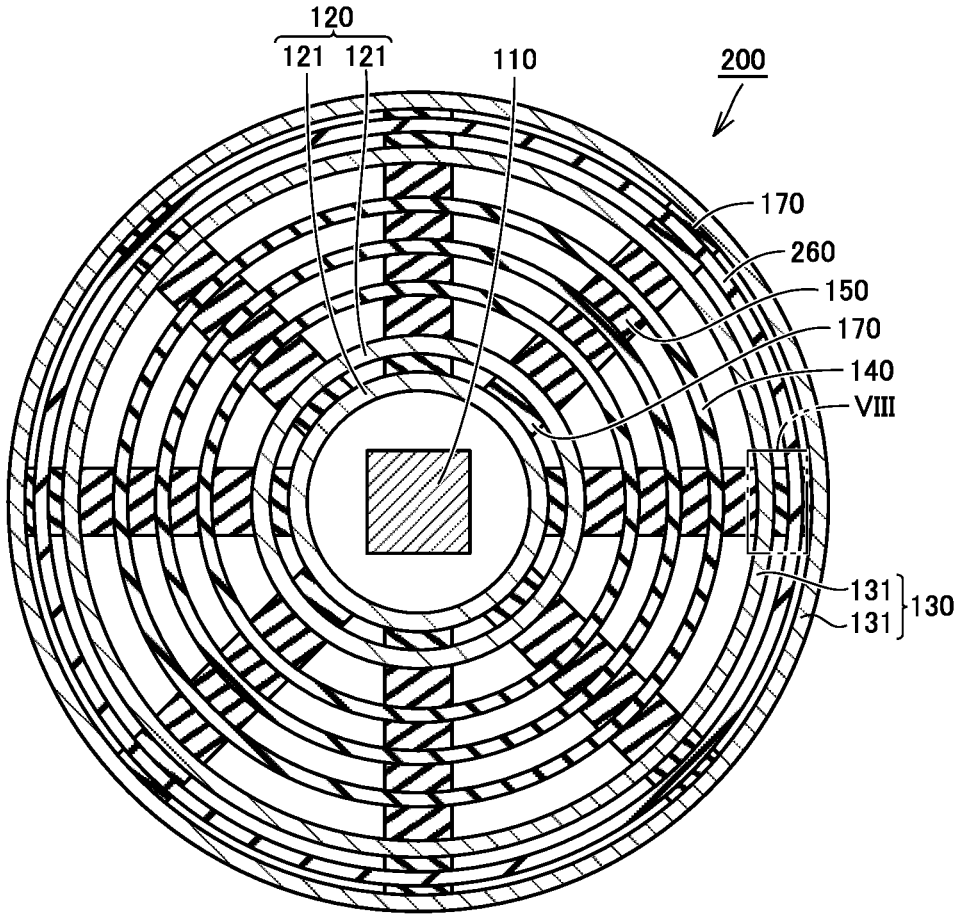
FIG. 7 is a sectional view of a stationary induction apparatus according to Embodiment 2 of the present invention.
Figure 8:
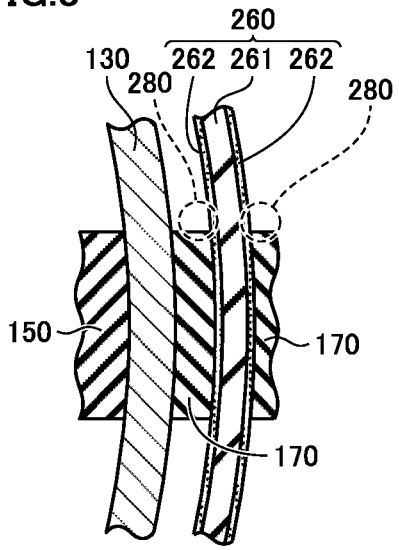
FIG. 8 is a sectional view of the stationary induction apparatus according to Embodiment 2 of the present invention, which shows an enlarged portion VIII of FIG. 7.

FIG. 7 is a sectional view of the stationary induction apparatus according to Embodiment 2 of the present invention. FIG. 7 is shown in sectional view similarly to FIG. 2. FIG. 8 is a sectional view of the stationary induction apparatus according to Embodiment 2 of the present invention and shows an enlarged portion VIII of FIG. 7.

As shown in FIGS. 7 and 8, stationary induction apparatus 200 according to Embodiment 2 of the present invention includes a second insulator 260. Second insulator 260 includes second nonlinear resistive layers 262 containing a nonlinear resistive material having a nonlinear volume resistivity that decreases when an electric field acting on the nonlinear resistive material is higher than a threshold.

In the present embodiment, second insulator 260 includes a second insulating layer 261 made of nonlinear resistive material and second nonlinear resistive layers 262 covering each of the opposite surfaces of second insulating layer 261. Second nonlinear resistive layers 262 are provided in a portion of second insulator 260 which is at least in contact with second insulating spacer 170. Used as the material for second insulating layer 261 is, for example, a press board. Second nonlinear resistive layer 262 has a configuration similar to that of first nonlinear resistive layer 142.

In stationary induction apparatus 200 according to the present embodiment, an electric field acts on an oil gap 280 surrounded by second insulator 260 and second insulating spacer 170 in a concentrated manner, as shown in FIG. 8. When the electric field acting on second nonlinear resistive layer 262 contacting oil gap 280 is higher than test electric field Et, the volume resistivity of second nonlinear resistive layer 262 decreases, thus preventing or reducing the occurrence of partial discharge in oil gap 280.

As described above, in stationary induction apparatus 200 according to the present embodiment, second nonlinear resistive layers 262 provided on the surface of second insulator 260 can stably relax electric field concentration on oil gap 280, thus enhancing the insulation performance in second winding 130. In the case where second insulator 260 is arranged between adjacent winding layers 121 of first winding 120, the insulation performance in first winding 120 can be enhanced.

Second nonlinear resistive layers 262 are provided not to second insulating spacers 170 but to second insulators 260 that are arranged fewer than second insulating spacers 170, thus suppressing an increase in the time required for manufacturing stationary induction apparatus 200. Consequently, stationary induction apparatus 200 can be manufactured inexpensively.

Although second nonlinear resistive layers 262 are provided over the entire opposite surfaces of second insulator 260 in the present embodiment, it suffices that second nonlinear resistive layers 262 are provided in the portions of second insulator 260 which are at least in contact with second insulating spacer 170. As in the modification of Embodiment 1, second nonlinear resistive layer 262 is preferably provided in a range including a portion of second insulator 260 which is in contact with second insulating spacer 170 and is wider than this portion.

Embodiment 3

A stationary induction apparatus according to Embodiment 3 of the present invention will be described below. Since a stationary induction apparatus 300 according to Embodiment 3 of the present invention differs from stationary induction apparatus 100 according to Embodiment 1 only in that the first insulator includes the first nonlinear layer alone, the components similar to those of stationary induction apparatus 100 according to Embodiment 1 will be denoted by the same reference signs, and description thereof will not be repeated.

Figure 9:
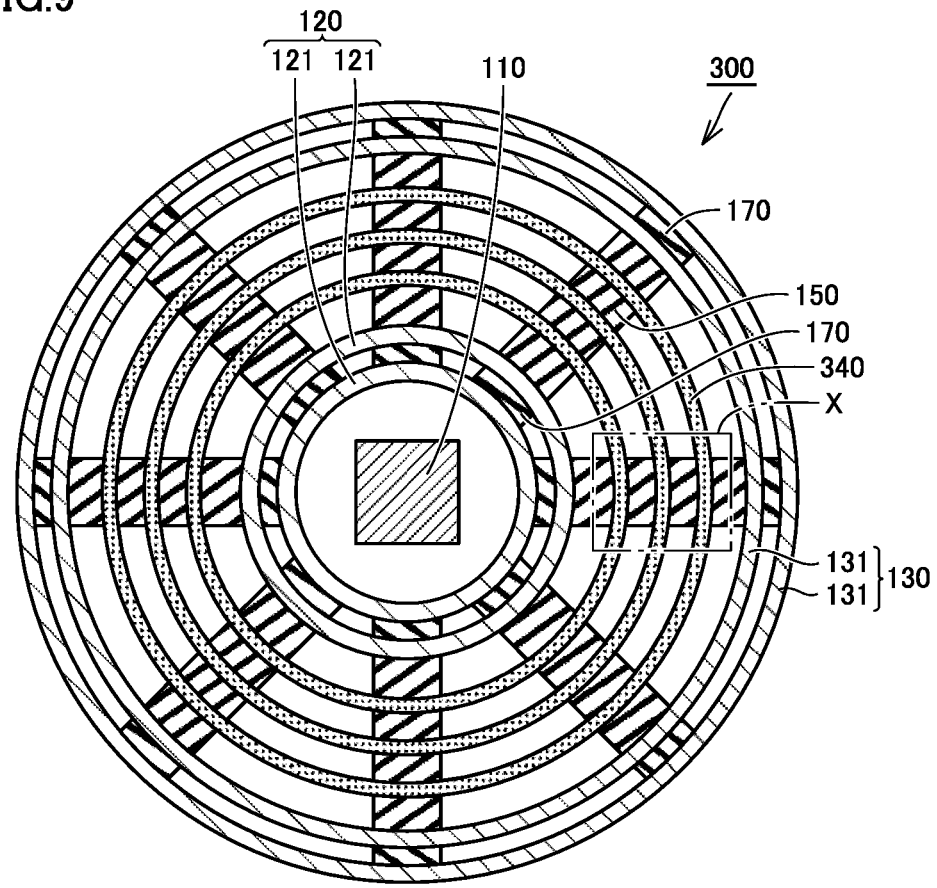
FIG. 9 is a sectional view of a stationary induction apparatus according to Embodiment 3 of the present invention.
Figure 10:
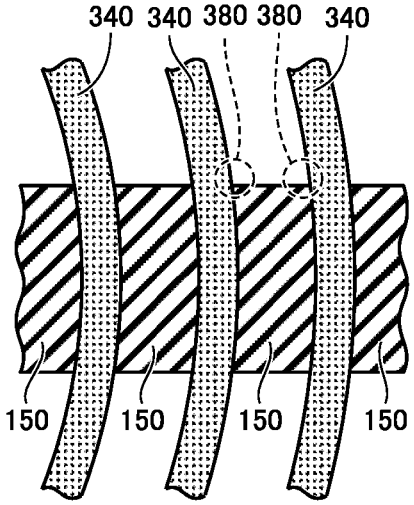
FIG. 10 is a sectional view of the stationary induction apparatus according to Embodiment 3 of the present invention, which shows an enlarged portion X of FIG. 9.

FIG. 9 is a sectional view of the stationary induction apparatus according to Embodiment 3 of the present invention. FIG. 9 is shown in sectional view similarly to FIG. 2. FIG. 10 is a sectional view of the stationary induction apparatus according to Embodiment 3 of the present invention, which shows an enlarged portion X of FIG. 9.

As shown in FIGS. 9 and 10, a stationary induction apparatus 300 according to Embodiment 3 of the present invention includes first insulators 340. First insulator 340 includes the first nonlinear resistive layer alone. The first nonlinear resistive layer forming first insulator 340 has a configuration similar to that of first nonlinear resistive layer 142. First insulator 340 and first insulating spacers 150 are included in the insulating structure.

Also in first insulator 340 of stationary induction apparatus 300 according to Embodiment 3 of the present invention, electric field concentration on an oil gap 380 surrounded by first insulator 340 and first insulating spacer 150 can be relaxed stably, thus enhancing the insulation performance between first winding 120 and second winding 130.

Second insulator 260 of stationary induction apparatus 200 according to Embodiment 2 of the present invention may include second nonlinear resistive layer 262 alone. Also in this case, second nonlinear resistive layer 262 provided can stably relax electric field concentration on oil gap 280, thus enhancing the insulation performance in second winding 130.

Embodiment 4

A stationary induction apparatus according to Embodiment 4 of the present invention will be described below. Since the stationary induction apparatus according to the present embodiment differs from the stationary induction apparatus according to Embodiment 1 mainly in that it is a shell-type transformer, the components similar to those of the stationary induction apparatus according to Embodiment 1 will not be described repetitively.

Figure 11:
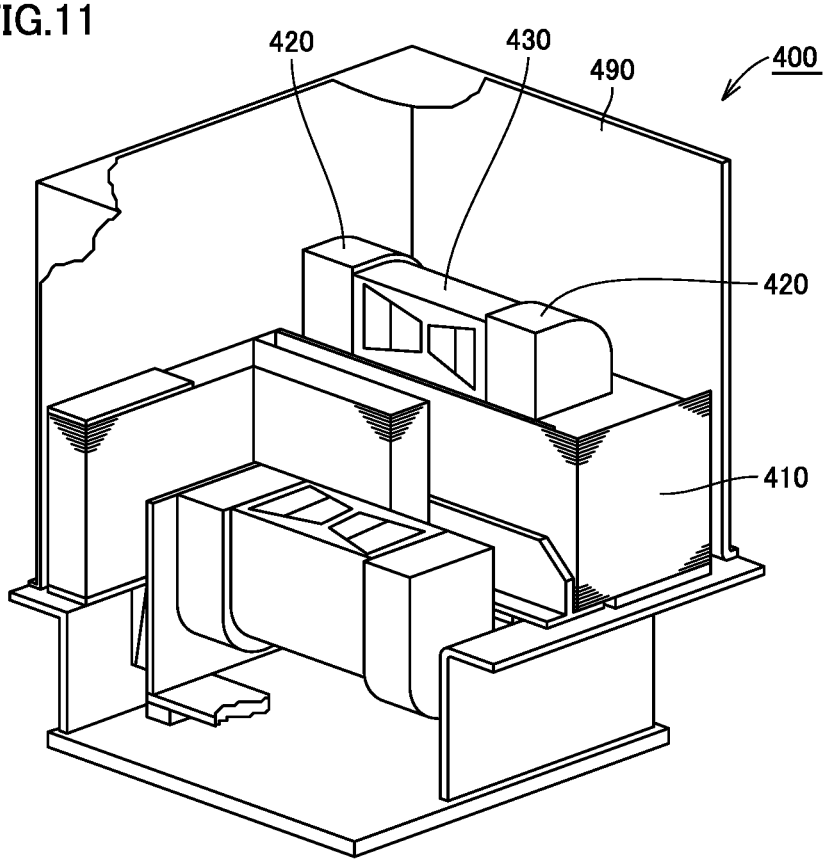
FIG. 11 is a perspective view showing an appearance of a stationary induction apparatus according to Embodiment 4 of the present invention.
Figure 12:
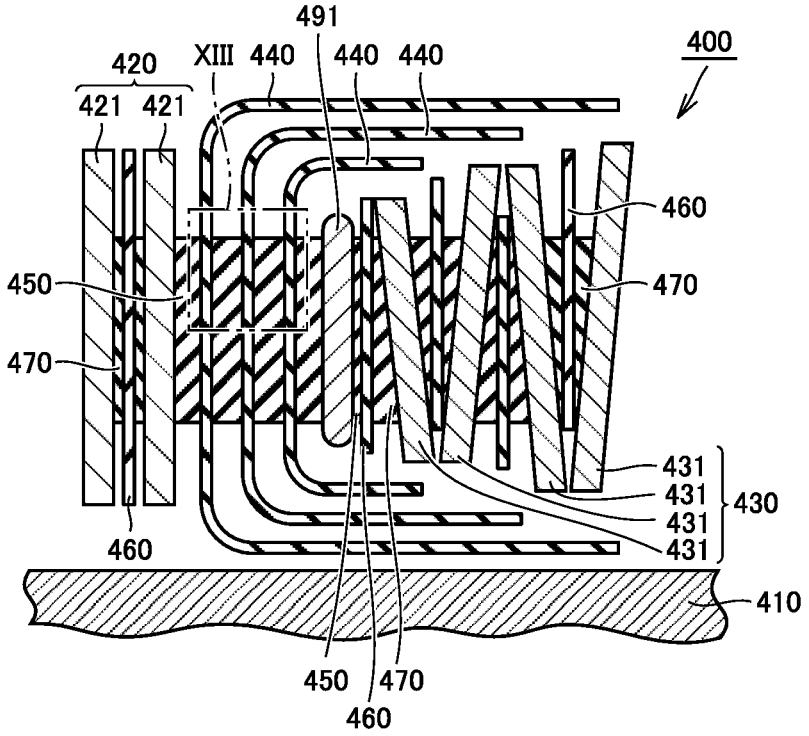
FIG. 12 is a partial sectional view of the stationary induction apparatus according to Embodiment 4 of the present invention.
Figure 13:
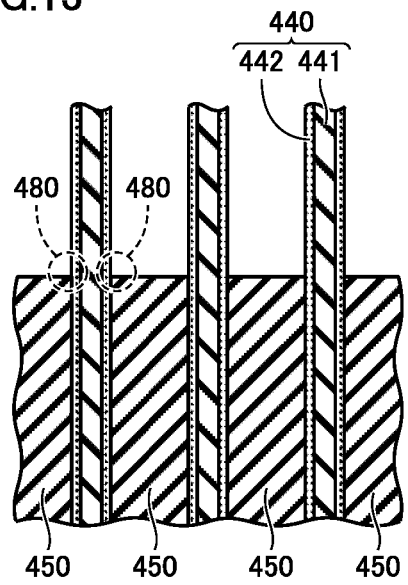
FIG. 13 is a sectional view of the stationary induction apparatus according to Embodiment 4 of the present invention, which shows an enlarged portion XIII of FIG. 12.

FIG. 11 is a perspective view showing an appearance of the stationary induction apparatus according to Embodiment 4 of the present invention. FIG. 12 is a partial sectional view of the stationary induction apparatus according to Embodiment 4 of the present invention. FIG. 13 is a sectional view of the stationary induction apparatus according to Embodiment 4 of the present invention, which shows an enlarged portion XIII of FIG. 12. FIG. 12 shows only the portion above the core.

As shown in FIG. 11, a stationary induction apparatus 400 according to Embodiment 4 of the present invention includes a core 410, and first windings 420 and a second winding 430 wound around the main leg of core 410 to be coaxially arranged, where the main leg is the central axis. In the direction along central axes of first windings 420 and second winding 430, second winding 430 is arranged so as to be sandwiched between first windings 420.

Stationary induction apparatus 400 further includes a tank 490. Tank 490 is filled with the insulating oil that is an insulating medium as well as a cooling medium. Core 410, first windings 420, and second winding 430 are housed in tank 490.

As shown in FIG. 12, first winding 420 is formed of a plurality of winding layers 421 coaxially arranged and electrically connected to each other. Each of winding layers 421 is formed of a flat-type electric wire wound in a substantially rectangular shape. Second winding 430 is formed of a plurality of winding layers 431 coaxially arranged and electrically connected to each other. Each of winding layers 431 is formed of a flat-type electric wire wound in a substantially rectangular shape.

Stationary induction apparatus 400 further includes a first insulator 440, a second insulator 460, a first insulating spacer 450, a second insulating spacer 470, and an electrostatic shield 491. First insulator 440 and first insulating spacers 450 are included in the insulating structure.

Electrostatic shield 491 has a substantially rectangular outside shape and has an opening at its central portion when seen from the direction along the central axes of first windings 420 and second winding 430. Electrostatic shield 491 is arranged so as to face the end surface of second winding 430 in the direction along the central axis of second winding 430. Electrostatic shield 491 is formed of a conductor and an insulator covering the surface of the conductor. Electrostatic shield 491 does not necessarily need to be provided.

First insulator 440 has a substantially rectangular outside shape and has an opening in its central portion when seen from the central axes of first windings 420 and second winding 430. First insulator 440 is arranged coaxially with first windings 420 and second winding 430.

In the present embodiment, three first insulators 440 are arranged between first winding 420 and second winding 430. The number of first insulators 440 arranged between first winding 420 and second winding 430 is changed appropriately depending on the magnitude of a potential difference generated between first winding 420 and second winding 430.

First insulating spacers 450 are each arranged between first winding 420 and first insulator 440 and between second winding 430 and first insulator 440 and extend along the extension direction parallel to the central axis. Used as first insulating spacer 450 is, for example, a press board or a resin stack.

First insulating spacers 450 are each arranged at regular intervals circumferentially of the central axis between winding layer 421 and first insulator 440 adjacent to each other, between adjacent first insulators 440, and between electrostatic shield 491 and first insulator 440 adjacent to each other. A portion between winding layer 421 and first insulator 440 adjacent to each other, a portion between adjacent first insulators 440, and a portion between electrostatic shield 491 and first insulator 440 adjacent to each other, in which no first insulating spacer 450 is located, serve as a flow path for the insulating oil.

The intervals at which first insulating spacers 450 are arranged circumferentially are not limited to regular intervals. It suffices that these intervals may be determined so as to maintain the interval between winding layer 421 and first insulator 440 adjacent to each other, the interval between adjacent first insulators 440, and the interval between electrostatic shield 491 and first insulator 440 adjacent to each other.

Second insulator 460 has a substantially rectangular outside shape and has an opening in its central portion when seen from the direction along the central axes of first windings 420 and second winding 430. Second insulator 460 is located at an interval from each of adjacent winding layers 421 of winding layers 421 so as to isolate adjacent winding layers 421 from each other in first winding 420. Second insulator 460 is located at an interval from each of adjacent winding layers 431 of winding layers 431 so as to isolate adjacent winding layers 431 from each other in second winding 430.

In the present embodiment, one second insulator 460 is arranged between adjacent winding layers 421 of first winding 420. One second insulator 460 is arranged between adjacent winding layers 431 of second winding 430, and one second insulator 460 is between electrostatic shield 491 and winding layer 431 adjacent to each other. Used as second insulator 460 is, for example, a press board.

The number of second insulators 460 arranged between adjacent winding layers 421 is changed appropriately depending on the magnitude of a potential difference generated between adjacent winding layers 421. The number of second insulators 460 arranged between adjacent winding layers 431 is changed appropriately depending on the magnitude of a potential difference generated between adjacent winding layers 431.

Second insulating spacers 470 are each arranged between adjacent winding layers 421 of first winding 420 and between adjacent winding layers 431 of second winding 430 and extend along the extension direction parallel to the central axis. Used as second insulating spacer 470 is, for example, a press board or a resin stack.

Second insulating spacers 470 are each arranged at regular intervals circumferentially of the central axis between adjacent winding layers 421 of first winding 420, between winding layer 431 and second insulator 460 adjacent to each other, and between adjacent second insulators 460. A portion between adjacent winding layers 421 of first winding 420, a portion between winding layer 431 and second insulator 460 adjacent to each other, and a portion between adjacent second insulators 460, in which no second insulating spacer 470 is located, serve as a flow path for the insulating oil.

The intervals at which second insulating spacers 470 are arranged circumferentially are not limited to regular intervals. It suffices that these intervals may be determined so as to maintain the interval between adjacent winding layers 421 of first winding 420, the interval between winding layer 431 and second insulator 460 adjacent to each other, and the interval between adjacent second insulators 460.

As shown in FIG. 13, first insulator 440 includes first nonlinear resistive layer 442 containing a nonlinear resistive material having a nonlinear volume resistivity that decreases when an electric field acting on the nonlinear resistive material is higher than a threshold. In the present embodiment, first insulator 440 includes first insulating layer 441 made of insulating material and first nonlinear resistive layers 442 covering the opposite surfaces of first insulating layer 441. First nonlinear resistive layer 442 is provided in a portion of first insulator 440 which is at least in contact with first insulating spacer 450. Used as the material for first insulating layer 441 is, for example, a press board. First nonlinear resistive layer 442 has a configuration similar to that of first nonlinear resistive layer 142.

In stationary induction apparatus 400 according to the present embodiment, an electric field acts on an oil gap 480 surrounded by first insulator 440 and first insulating spacer 450 in a concentrated manner, as shown in FIG. 13. When the electric field acting on first nonlinear resistive layer 442 contacting oil gap 480 is higher than test electric field Et, the volume resistivity of first nonlinear resistive layer 442 decreases, thus preventing or reducing the occurrence of partial discharge in oil gap 480.

Stationary induction apparatus 400 according to the present embodiment, which includes first nonlinear resistive layers 442 provided on the surfaces of first insulator 440, can stably relax electric field concentration on oil gap 480, thus enhancing the insulation performance between first winding 420 and second winding 430. First nonlinear resistive layers 442 are provided not to first insulating spacers 450 but to first insulator 440 that are arranged fewer than first insulating spacers 450, thus suppressing an increase in the time required for manufacturing stationary induction apparatus 400. Consequently, stationary induction apparatus 400 can be manufactured inexpensively.

In the description of the above embodiments, configurations that can be combined may be combined with each other. Embodiments 1, 2, and 3 have described a core-type transformer using an insulating oil as a stationary induction apparatus, and Embodiment 4 has described a shell-type transformer using an insulating oil. The present invention, however, is also applicable to any other type of stationary induction apparatus such as a reactor using an insulating oil or an insulating gas, and can achieve similar effects.

It should be construed that the embodiments disclosed herein are given by way of illustration in all respects, not by way of limitation. It is therefore intended that the scope of the present invention is defined by claims, not only by the embodiments described above, and encompasses all modifications and variations equivalent in meaning and scope to the claims.

REFERENCE SIGNS LIST

100, 200, 300, 400 stationary induction apparatus, 110, 410 core, 120, 420 first winding, 121, 131, 421, 431 winding layer, 130, 430 second winding, 140, 140*a*, 240, 340, 440 first insulator, 141, 441 first insulating layer, 142, 142*a*, 442 first nonlinear resistive layer, 150, 450 first insulating spacer, 160, 260, 460 second insulator, 170, 470 second insulating spacer, 180, 280, 380, 480 oil gap, 261 second insulating layer, 262 second nonlinear resistive layer, 490 tank, 491 electrostatic shield.

The invention claimed is:

1. A stationary induction apparatus comprising:

a core;

a first winding and a second winding each wound in a cylindrical shape with the core as its central axis, the first winding and the second winding having facing surfaces that face with each other; and an insulating structure arranged between the facing surfaces of the first winding and the second winding, the insulating structure including a first insulator located between the facing surfaces of the first winding and the second winding at intervals from the first winding and the second winding, the first insulator having a cylindrical shape with the core as its central axis, and a plurality of first insulating spacers each arranged between the first winding and the first insulator and between the second winding and the first insulator, the plurality of first insulating spacers extending along an extension direction parallel to the central axis, the first insulator including a first nonlinear resistive layer containing a nonlinear resistive material having a nonlinear volume resistivity that decreases when an electric field acting on the nonlinear resistive material is higher than a threshold, the first nonlinear resistive layer being provided in a portion of the first insulator which is at least in contact with a corresponding one of the plurality of first insulating spacers.

2. The stationary induction apparatus according to claim 1, wherein the first nonlinear resistive layer is provided in a range that includes the portion of the first insulator which is in contact with one of the plurality of first insulating spacers, the range being wider than the portion.

3. The stationary induction apparatus according to claim 1, wherein the first insulator includes the first nonlinear resistive layer alone.

4. The stationary induction apparatus according to claim 1, wherein the first insulator includes a first insulating layer made of an insulating material, and the first nonlinear resistive layer covering at least part of each of opposite surfaces of the first insulating layer.

5. The stationary induction apparatus according to claim 1, wherein each of the first winding and the second winding includes a plurality of winding layers electrically connected to each other, the stationary induction apparatus further comprises a second insulator located at an interval from each of adjacent winding layers of the plurality of winding layers so as to insulate the adjacent winding layers from each other in at least one of the first winding and the second winding, and a plurality of second insulating spacers that are arranged between the adjacent winding layers and extend along an extension direction parallel to the central axis in each of the first winding and the second winding, the second insulator includes a second nonlinear resistive layer containing a nonlinear resistive material having a nonlinear volume resistivity that decreases when an electric field acting on the nonlinear resistive material is higher than a threshold, and the second nonlinear resistive layer is provided in a portion of the second insulator which is at least in contact with one of the plurality of second insulating spacers.

6. The stationary induction apparatus according to claim 5, wherein the second nonlinear resistive layer is provided in a range that includes the portion of the second insulator which is in contact with one of the plurality of second insulating spacers, the range being wider than the portion.

7. The stationary induction apparatus according to claim 5, wherein the second insulator includes the second nonlinear resistive layer alone.

8. The stationary induction apparatus according to claim 5, wherein the second insulator includes a second insulating layer made of an insulating material and the second nonlinear resistive layer covering at least part of each of opposite surfaces of the second insulating layer.

9. The stationary induction apparatus according to claim 1, wherein the insulating structure includes a plurality of the first insulators.

10. The stationary induction apparatus according to claim 5, comprising a plurality of the second insulators.

* * * * *